US005507600A

United States Patent [19]

Takahashi

[11] Patent Number: 5,507,600

[45] Date of Patent: Apr. 16, 1996

[54] REFLECTING BODY HAVING HIGH LUMINANCE

[75] Inventor: Eizo Takahashi, Soka, Japan

[73] Assignee: Miyama Kogyo Kabushiki Kaisha, Soka, Japan

[21] Appl. No.: 353,436

[22] Filed: Dec. 9, 1994

[30] Foreign Application Priority Data

Aug. 11, 1994 [JP] Japan ..... 6-010094 U

[51] Int. Cl.[6] ..... E02D 29/14; E03F 5/02

[52] U.S. Cl. ..... 405/303; 404/14; 404/25

[58] Field of Search ..... 404/13, 14, 25; 405/303

[56] References Cited

U.S. PATENT DOCUMENTS 2,109,287 2/1938 Elkington ..... 404/25
4,303,305 12/1981 Jones ..... 404/14 X
4,597,691 7/1986 Clarke ..... 404/14 X
5,308,186 5/1994 Hedgewick ..... 404/14

*Primary Examiner*—Stephen J. Novosad
*Attorney, Agent, or Firm*—Flynn, Thiel, Boutell & Tanis

[57] ABSTRACT

Landings and/or manhole covers formed of a plurality of plate bodies each having a plurality of apertures. Utilizing the plate bodies, a reflecting body having high luminance can be simply and surely provided on the landings and/or manhole covers and it is strong and easily manufactured. The reflecting body comprises a reflecting piece formed by a ceiling having a plurality of concaves and convexes at the rear surfaces thereof and a plurality of legs having windows at the intermediate portions thereof, and a stopper member which is mounted on the aperture of the plate body and has projections, wherein the ceiling is integrated with said plurality of legs and said ceiling and legs respectively made of polycarbonate, polyacrylate or other transparent high polymer substance, and wherein said projections of said stopper member are inserted into said windows of said plurality of legs.

4 Claims, 4 Drawing Sheets

REFLECTING BODY HAVING HIGH LUMINANCE

BACKGROUND OF THE INVENTION

1. Field of the Invention:

The present invention relates to a reflecting body having high luminance which is disposed on landings and/or manhole covers which are respectively arranged in a manhole body and formed of a plurality of plate bodies each having a plurality apertures.

2. Prior Art:

A typical manhole body 23 is shown in FIG. 6. The manhole body 23 is formed by excavating a ground 21 to form a vertical hole 22 having a large diameter and covering the peripheral surface of the vertical hole 22 with concrete. There is formed an inlet manhole 26 having a small diameter through which an operator gets in for inspecting, repairing and cleaning a sewer pipe, communication lines, etc. 25 (hereinafter referred to as sewer pipe, etc. 25) which is disposed at the lowest end portion 24 of the manhole body 23. Since the manhole body 23 is formed of a vertical long hole, there are provided on the wall surface thereof a foothold or staircase 27 composed of a plurality steps and a plurality of landings 28 having manholes 29 through which the operator gets in or out and which are normally closed by manhole covers 30.

When inspecting, repairing, cleaning the sewer pipe, etc. 25, the operator gets in the manhole body 23 through the manhole 26 using the foothold 27, then he reaches the first landing 28 using the foothold 27. Successively, he opens the manhole cover 30 provided on the first landing 28 and steps down using the foothold 27 and reaches the next landing 28. The operator repeats the same actions and reaches the lowest end portion 24 so as to inspect, repair, clean the sewer pipe, etc. 25. There is a modification of the landing 28 and manhole cover 30 employing a plurality of plate bodies each having a plurality of apertures and made of synthetic resin for improving the ventilation as shown in FIG. 5.

However, even if the landing 28 and/or manhole cover 30 is formed of such a plate body so as to improve the ventilation as shown in FIG. 5, there is no sufficient transparency in the manhole body 23 so that the landing 28 is dark, which makes it difficult to confirm the position of the manhole 29 or manhole cover 30. As a result, it causes such a problem that it is difficult for the operator to get in or out from the manhole 29 and to move on the landing 28, which makes it difficult to inspect, repair and clean the sewer pipe, etc. 25.

SUMMARY OF THE INVENTION

The present invention has been made in view of the problem of the conventional structure and it is an object of the present invention to provide a reflecting body having high luminance which is strong and can be easily and surely mounted on the landing and/or manhole cover respectively formed of a plurality of plate bodies each having a plurality of apertures and which can be easily manufactured.

To achieve the object of the present invention, a reflecting body having high luminance according to a first aspect of the invention is disposed on landings arranged in a manhole body each of which is formed by a plurality of plate bodies each having a plurality of apertures, characterized in that it comprises a reflecting piece formed by a ceiling having a plurality of concaves and convexes at the rear surface thereof and a plurality of legs having windows at the intermediate portions thereof, and a stopper member which is mounted on the aperture of the plate body and has projections, wherein the ceiling is integrated with the legs and made of polycarbonate, polyacrylate or other transparent high polymer substance and projections of the stopper member are inserted into the windows of the legs.

A reflecting body having high luminance according to a second aspect of the invention is disposed on manhole covers arranged in a manhole body each of which is formed of a plurality of plate bodies each having a plurality of apertures, characterized in that it comprises a reflecting piece formed by a ceiling having a plurality of concaves and convexes at the rear surface thereof and a plurality of legs having windows at the intermediate portions thereof, and a stopper member which is mounted on the aperture of the plate body and has projections, wherein the ceiling is integrated with the legs and made of polycarbonate, polyacrylate or other transparent high polymer substance and projections of the stopper member are inserted into the windows of the legs.

A reflecting body having high luminance according to a third aspect of the invention is characterized in that the stopper member of the first and second aspects of the invention includes a flat plate, a plurality of legs having projections projected therefrom wherein a plurality of legs of the reflecting piece of the first and second aspects of the invention are inserted into the holes of the flat plate.

According to the first and second aspects of the invention, since each of the reflecting bodies has high luminance disposed on the landing and/or manhole cover arranged in the manhole body which is formed of a plurality of plate bodies each having a plurality of apertures comprises a reflecting piece formed by a ceiling having a plurality of concaves and convexes at the rear surface thereof and a plurality of legs integrated with the ceiling and both of the ceiling and the legs are made of polycarbonate, polyacrylate or other transparent high polymer, the reflecting body is strong and it is easily manufactured. Furthermore, since the projections projected from the stopper member, which are mounted on the aperture constituting the landing and/or manhole cover, are inserted into windows provided on the legs of the reflecting piece so as to hold the reflecting body in the aperture, the reflecting body is prevented from slipping out from the aperture of the plate body during the transportation or during use thereof after the reflecting body is installed on the landing and/or manhole cover, and hence reflecting body having high luminance can be surely held by the landing and/or manhole cover formed of a plurality of plate bodies each having a plurality of apertures. Still furthermore, since a plurality of concaves and convexes are formed on the back surface of the ceiling made of polycarbonate, polyacrylate or other transparent high polymer, the reflecting body having high luminance can reflect the light inside the manhole, thereby performing diffused reflection inside the manhole body and easily confirming the configuration of the landing and/or manhole cover.

According to the third aspect of the invention, since holes are penetrated through the flat plate of the stopper member and the legs of the reflecting piece are inserted into the holes of the flat plate and the projections are provided on the plurality of legs of the stopper member, the reflecting body can be easily mounted on the landing/or manhole and the reflecting body is not prevented from slipping out from the aperture of the plate body during the transportation or during use.

PREFERRED EMBODIMENT OF THE INVENTION

Figure 1:
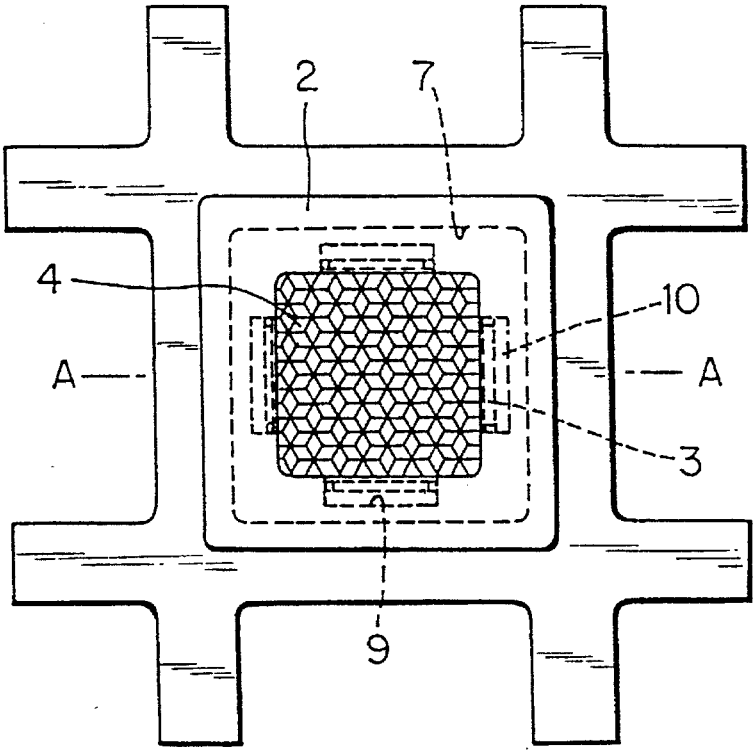
FIG. 1 is a plan view of a reflecting body having high luminance disposed on a plate body according to a preferred embodiment of the invention.
Figure 2:
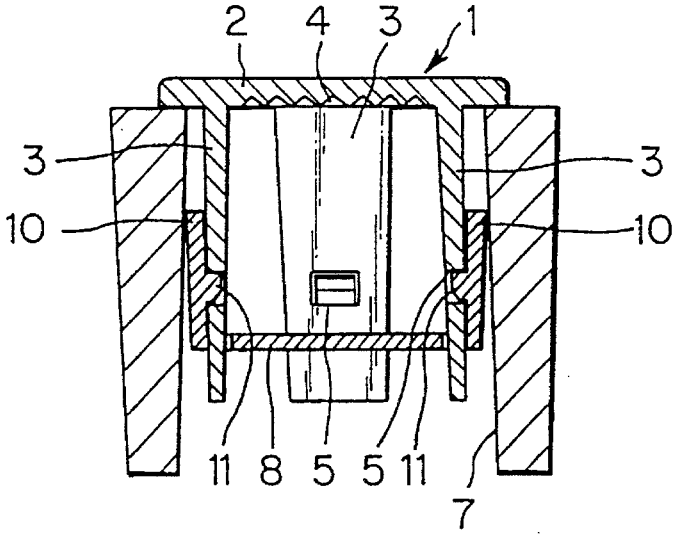
FIG. 2 is a cross-sectional view taken along A—A of FIG. 1.
Figure 3:
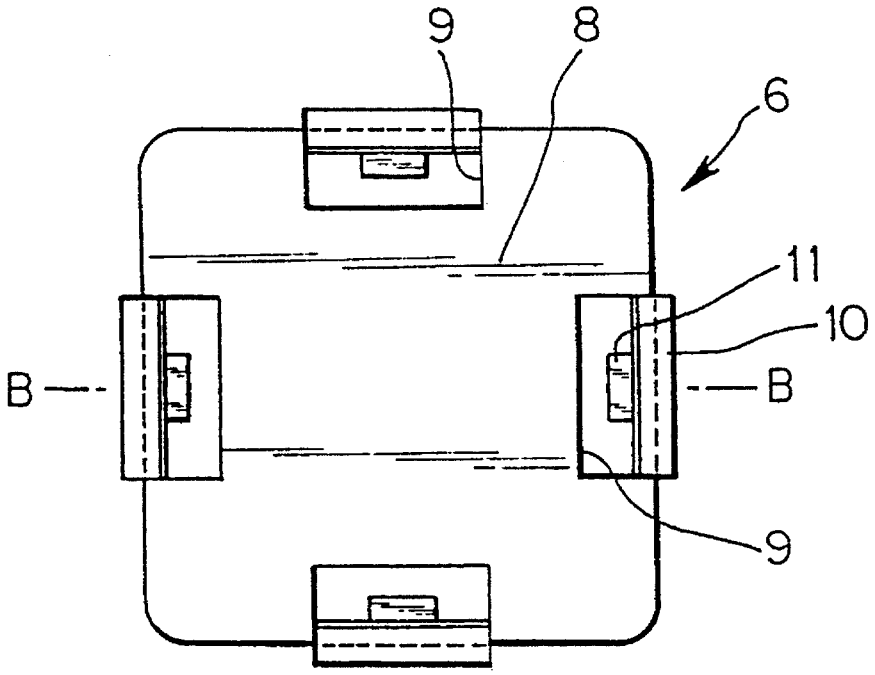
FIG. 3 is a plan view of a stopper member as a constituent of the reflecting body of FIG. 1.
Figure 4:
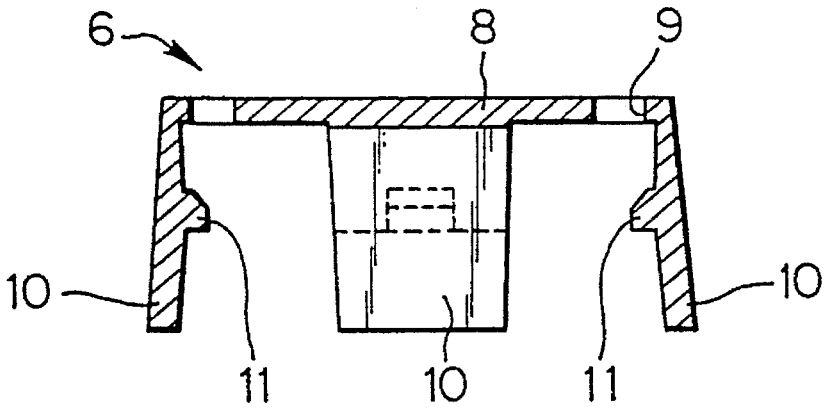
FIG. 4 is a cross-sectional view taken along B—B of FIG. 3.
Figure 5:
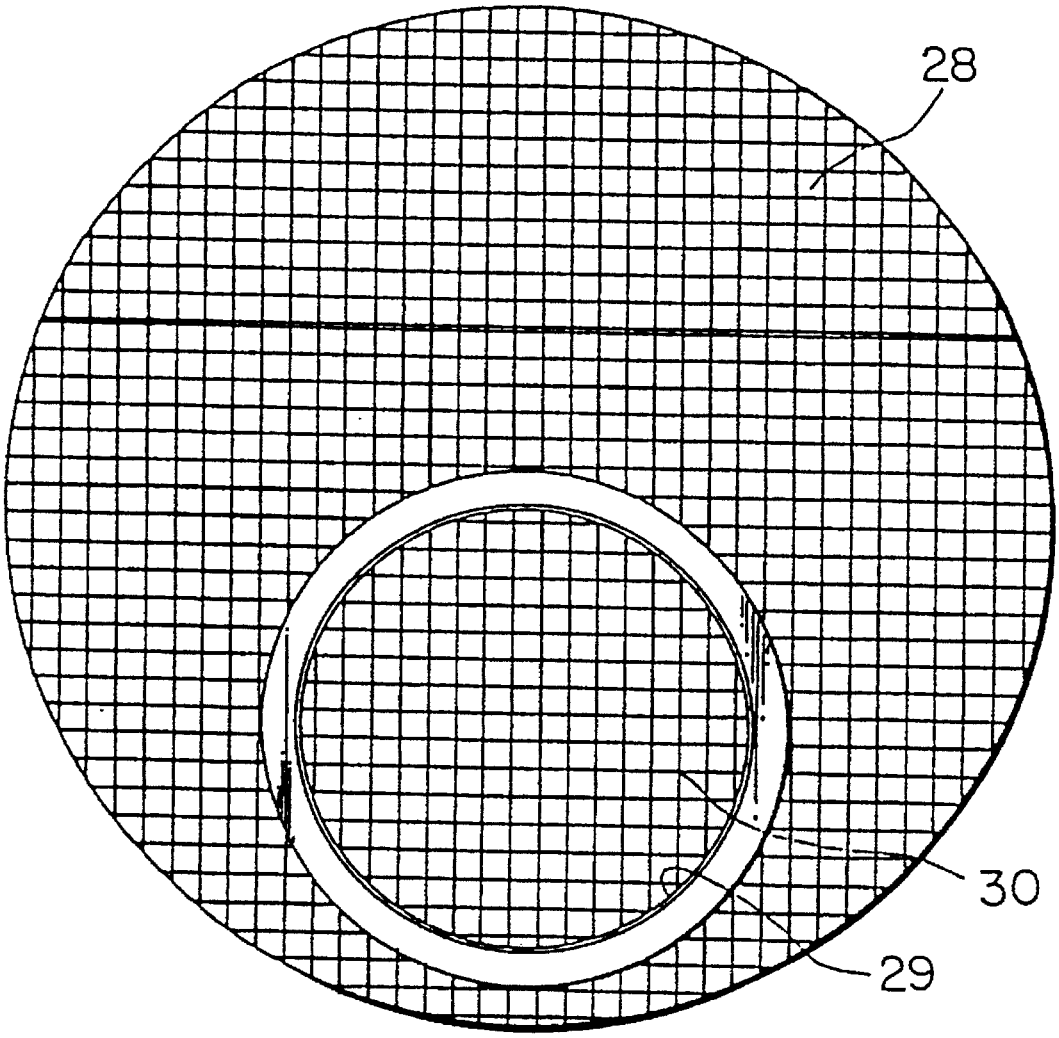
FIG. 5 (PRIOR ART)
FIG. 5 is a plan view of landings and manholes of a conventional manhole body.
Figure 6:
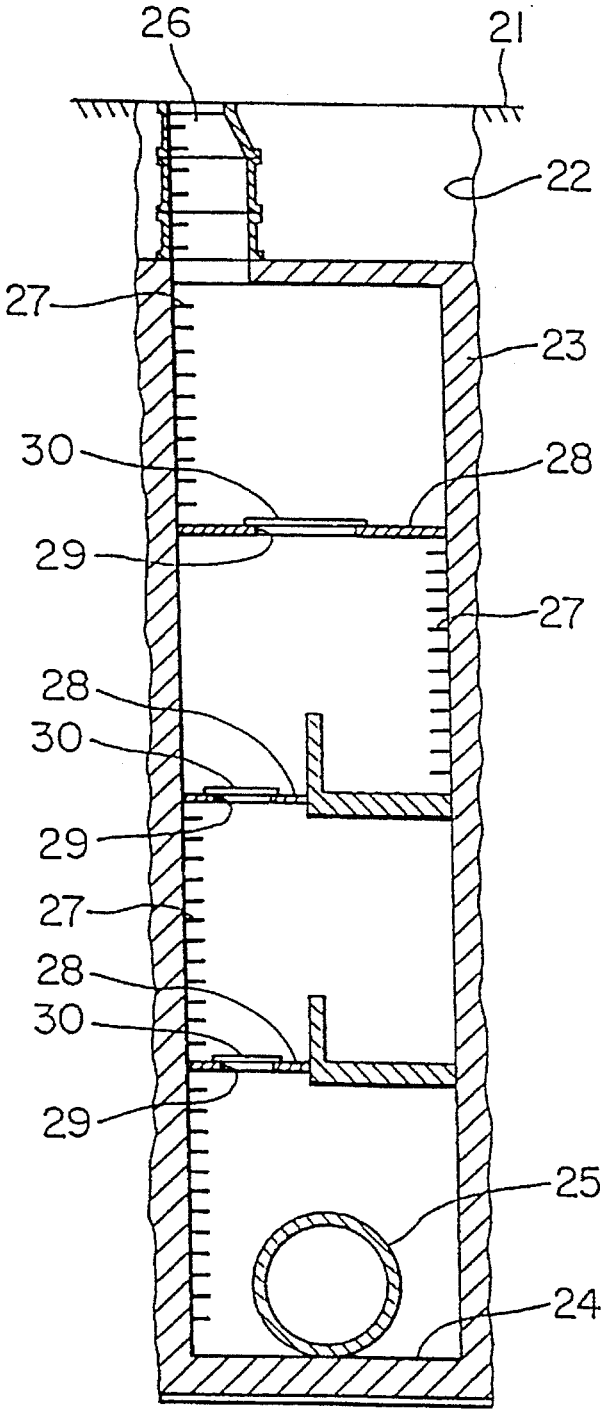
FIG. 6 (PRIOR ART)
FIG. 6 is a cross-sectional view of the conventional manhole body of FIG. 5.

A preferred embodiment of the invention will be described with reference to FIGS. 1 to 4.

A reflecting body having high luminance is placed on a given aperture 7 of each landing and/or each manhole cover respectively formed of a plurality of plate bodies each having a plurality of apertures and comprises a reflecting piece I formed by a ceiling 2 which is formed integrally with a plurality of legs 3, 3 . . . positioned inside the aperture 7 and a stopper member 6 which is mounted on each aperture 7 of such landing and/or manhole cover.

The reflecting piece 1 is made of polycarbonate, polyacrylate or other transparent high polymer substance. A plurality of concaves and convexes 4 serving as reflecting parts are formed on the rear surface of the ceiling 2 when they are integrally formed with the legs 3, 3 . . . . The reflecting parts may be formed on the upper surface of the ceiling 2 in addition to those formed on the rear surface of the ceiling 2. Windows 5 are provided in each of the legs 3, 3 . . . at the intermediate portion thereof. The windows 5 are formed by perforating each leg 3 or recessing each leg. The stopper member 6 comprises a flat plate 8 and legs 10, 10 . . . wherein the flat plate 8 has holes 9, 9 . . . which are formed by penetrating the flat plate 8 and through which the legs 3 and 3 of the reflecting piece 1 are inserted and the legs 10, 10 . . . have projections 11, 11 . . . which are respectively projected inwardly. The stopper member 6 has a function to bring the legs 10, 10 . . . of the stopper member 6 into contact with the aperture 7 of the plate body so as to mount the legs 10, 10 . . . on the aperture 7.

The reflecting body is placed in the aperture 7 of the landing and/or manhole cover respectively formed of a plurality of plate bodies each having a plurality of apertures and the legs 3, 3 . . . are positioned inside the aperture 7. In this state, when the stopper member 6 is inserted into the aperture 7 from the lower portion of the aperture 7 while the legs 10, 10 . . . of the stopper member 6 are directed upward, the tip ends of the legs 3 and 3 penetrate the holes 9, 9 . . . of the flat plate 8 and the projections 11 and 11 of the legs 10, 10 . . . are inserted into the windows 5 of the legs 3, 3 . . . so that the stopper member 6 is integrated with the reflecting piece 1 and the legs 10, 10 . . . of the stopper member 6 are mounted on the aperture 7 of the plate body. As a result, the reflecting piece 1 can be disposed at and held by a given aperture 7 of the landing and/or manhole cover with assurance.

The reflecting body may be held by a given aperture 7 of the landing and/or manhole cover in the following manner. That is, firstly, the legs 10, 10 . . . of the stopper member 6 is mounted at the intermediate portion of the aperture 7 while the flat plate 8 is directed upward, secondly, the legs 3, 3 . . . of the reflecting piece 1 are inserted into the aperture 7 , thirdly, the legs 3, 3 . . . are inserted into the holes 9, 9 . . . of the flat plate 8, and finally the projections 11, 11 . . . of the stopper member are inserted into and held by the windows 5 of the legs 3, 3 . . . .

As mentioned above, the reflecting body is disposed on the landing and/or manhole cover respectively formed of a plurality of plate bodies each having a plurality of apertures and it is arranged in the manhole body. The reflecting body comprises the reflecting piece 1 formed by the ceiling 2 having a plurality of concaves and convexes 4 at the rear surface thereof and a plurality of legs 3, 3 . . . integrated with the ceiling 2 wherein the ceiling 2 and the plurality of legs 3, 3 . . . are made of polycarbonate, polyacrylate or other transparent high polymer substance, so that the reflecting body is strong and it is easily manufactured. Furthermore, the reflecting body can be disposed at and held by a given aperture 7 of the landing and/or manhole cover by mounting the legs 3, 3 . . . on the aperture 7 utilizing the stopper member 6 and the aperture 7 constituting the landing and/or manhole cover. Still furthermore, since a plurality of concaves and convexes 4 are formed on the rear surface of the ceiling 2 made of the polycarbonate, polyacrylate or other transparent high polymer substance, the reflecting body can reflect the light inside the manhole, thereby performing diffused reflection inside the manhole body so that the configuration of the landing and/or manhole cover can be easily confirmed and the operator can move easily on the landing and/or manhole cover. When the concaves and convexes 4 are formed on both the upper and rear surfaces of the ceiling 2, diffusing reflection can be performed more effectively.

According to the first aspect of the invention, since the reflecting body having high luminance disposed on the landing arranged in the manhole body which is formed of a plurality of plate bodies each having a plurality of apertures comprises a reflecting piece formed by a ceiling having a plurality of concaves and convexes at the rear surface thereof and a plurality of legs integrated with the ceiling and both of the ceiling and the legs are made of polycarbonate, polyacrylate or other transparent high polymer, the reflecting body is strong and it is easily manufactured. Furthermore, the reflecting body can be easily and surely disposed at a given position of the flat plate by mounting the legs of the stopper member on the aperture. If the reflecting body is applied to the landing, the landing becomes bright to thereby clearly define the landing area. As a result, the operator can easily move on the landing, since the legs are inserted into the aperture.

According to the second aspect of the invention, since the reflecting body having high luminance disposed on the manhole cover arranged in the manhole body which is formed of a plurality of plate bodies each having a plurality of apertures comprises a reflecting piece formed by a ceiling having a plurality of concaves and convexes at the rear surface thereof and a plurality of legs integrated with the ceiling and both of the ceiling and the legs are made of polycarbonate, polyacrylate or other transparent high polymer, the reflecting body is strong and it is easily manufactured. Furthermore, the reflecting body can be easily and surely disposed at a given position of the flat plate by mounting the legs of the stopper member on the aperture. If the reflecting body is applied to the landing, the landing becomes bright to thereby clearly define the landing area. As a result, the operator can easily get in or out from the manhole hole by opening the manhole cover.

According to the third aspect of the invention, since holes are penetrated through the flat plate of the stopper member and the legs of the reflecting piece are inserted into the holes of the flat plate and the projections are provided on the plurality of legs of the stopper member, the reflecting body can be easily mounted on the landing/or manhole and the reflecting body is not prevented from slipping out from the aperture of the plate body during the transportation or during use thereof.

What is claimed is:

1. In a reflecting body having high luminance disposed on landings arranged in a manhole body which is formed of a plurality of plate bodies each having a plurality of apertures, said reflecting body comprises:

a reflecting piece formed by a ceiling having a plurality of concaves and convexes at the rear surfaces thereof and a plurality of legs having windows at the intermediate portions thereof; and a stopper member which is mounted on the aperture of the plate body and has projections, wherein the ceiling is integrated with said plurality of legs and said ceiling and legs respectively made of polycarbonate, polyacrylate or other transparent high polymer substance, and wherein said projections of said stopper member are inserted into said windows of said plurality of legs.

2. In a reflecting body having high luminance disposed on manhole covers arranged in a manhole body which is formed of a plurality of plate bodies each having a plurality of apertures, said reflecting body comprises:

a reflecting piece formed by a ceiling having a plurality of concaves and convexes at the rear surfaces thereof and a plurality of legs having windows at the intermediate portions thereof; and a stopper member which is mounted on the aperture of the plate body and has projections, wherein the ceiling is integrated with said plurality of legs and said ceiling and legs respectively made of polycarbonate, polyacrylate or other transparent high polymer substance, and wherein said projections of said stopper member are inserted into said windows of said plurality of legs.

3. A reflecting body having high luminance according to claim 1, wherein said stopper member includes a flat plate, a plurality of legs having projections projected therefrom, and wherein a plurality of legs of said reflecting piece are inserted into said apertures of said flat plate.

4. A reflecting body having high luminance according to claim 2, wherein said stopper member includes a flat plate, a plurality of legs having projections projected therefrom, and wherein a plurality of legs of said reflecting piece are inserted into said apertures of said flat plate.

* * * * *